US010041362B2

(12) United States Patent
Belshaw

(10) Patent No.: US 10,041,362 B2
(45) Date of Patent: Aug. 7, 2018

(54) BLADED ROTOR ARRANGEMENT AND A LOCK PLATE FOR A BLADED ROTOR ARRANGEMENT

(71) Applicant: ROLLS-ROYCE PLC, London (GB)

(72) Inventor: David Belshaw, Derby (GB)

(73) Assignee: ROLLS-ROYCE PLC, London (GB)

( * ) Notice: Subject to any disclaimer, the term of this patent is extended or adjusted under 35 U.S.C. 154(b) by 397 days.

(21) Appl. No.: 15/052,386

(22) Filed: Feb. 24, 2016

(65) Prior Publication Data

US 2016/0273370 A1 Sep. 22, 2016

(30) Foreign Application Priority Data

Mar. 20, 2015 (GB) ..... 1504725.1

(51) Int. Cl.
*F01D 5/30* (2006.01)
*F01D 11/00* (2006.01)
(Continued)

(52) U.S. Cl.
CPC ..... *F01D 5/3015* (2013.01); *F01D 5/081* (2013.01); *F01D 5/12* (2013.01); *F01D 11/006* (2013.01); *F01D 25/12* (2013.01); *F05D 2220/32* (2013.01); *F05D 2230/20* (2013.01); *F05D 2230/211* (2013.01); *F05D 2230/22* (2013.01);
(Continued)

(58) Field of Classification Search
CPC ..... F01D 5/081; F01D 5/12; F01D 5/3015; F01D 11/006; F01D 25/12; F05D 2220/32; F05D 2230/20; F05D 2230/211; F05D 2230/22; F05D 2230/31; F05D 2240/30; F05D 2240/81; F05D 2250/283
See application file for complete search history.

(56) References Cited

U.S. PATENT DOCUMENTS 4,217,755 A * 8/1980 Williams ..... F02C 7/18 415/115
4,882,902 A * 11/1989 Reigel ..... F01D 5/082 415/115
(Continued)

FOREIGN PATENT DOCUMENTS

EP 2009236 A2 12/2008
EP 2146055 A1 1/2010
(Continued)

OTHER PUBLICATIONS

Sep. 30, 2016 Search Report issued in European Patent Application No. 16156931.4.
(Continued)

*Primary Examiner* — Igor Kershteyn
(74) *Attorney, Agent, or Firm* — Oliff PLC

(57) ABSTRACT

A lock plate of a bladed rotor arrangement is hollow. The bladed rotor arrangement comprises is a bladed turbine rotor of a gas turbine engine. The hollow lock plate has reduced weight compared to a solid lock plate and reduces the centrifugal load on the rim of the rotor and reduces the stresses in the lock plate groove on the rotor blade and hence increases the working life of the rotor and the working life of the rotor blade respectively. The lock plate may have radially extending chambers and openings to provide a flow of coolant onto the rotor posts of the rotor.

18 Claims, 6 Drawing Sheets

(51) Int. Cl.

| | |
|---|---|
| ***F01D 25/12*** | (2006.01) |
| ***F01D 5/12*** | (2006.01) |
| ***F01D 5/08*** | (2006.01) |

(52) U.S. Cl.
CPC ..... *F05D 2230/31* (2013.01); *F05D 2240/30* (2013.01); *F05D 2240/81* (2013.01); *F05D 2250/283* (2013.01)

(56) References Cited

U.S. PATENT DOCUMENTS 4,890,981 A * 1/1990 Corsmeier ..... F01D 5/3015 416/220 R
5,018,943 A * 5/1991 Corsmeier ..... F01D 5/027 416/144
5,575,616 A * 11/1996 Hagle ..... F01D 5/081 415/115
5,700,130 A * 12/1997 Barbot ..... F01D 5/081 415/115
8,038,399 B1 10/2011 Liang
8,708,652 B2 * 4/2014 Caprario ..... F01D 5/3015 416/220 R
2009/0004012 A1 * 1/2009 Caprario ..... F01D 5/082 416/189
2010/0014986 A1 * 1/2010 Traverso ..... F01D 5/081 416/97 R
2011/0129342 A1 6/2011 Smoke et al.
2012/0107136 A1 * 5/2012 Buchal ..... F01D 5/3015 416/97 R

FOREIGN PATENT DOCUMENTS

EP 2236759 A1 10/2010
GB 2435909 A 9/2007

OTHER PUBLICATIONS

R. Bielzer et al; "Metal injection molding: freedom in design for sintered metal components;" Advances in Polymer Technology, Wiley and Sons; Jun. 21, 1991; vol. 11; No. 2; pp. 141-145.
Sep. 4, 2015 Search Report issued in British Patent Application No. 1504725.1.

* cited by examiner

BLADED ROTOR ARRANGEMENT AND A LOCK PLATE FOR A BLADED ROTOR ARRANGEMENT

The present disclosure concerns a bladed rotor arrangement and a lock plate for a bladed rotor arrangement and in particular to a bladed rotor arrangement of a gas turbine engine or a turbomachine and a lock plate for a bladed rotor arrangement of a gas turbine engine.

Gas turbine engines comprise a plurality of bladed rotors, each of which comprises a rotor and a plurality of rotor blades mounted on the periphery of the rotor. Each rotor blade has an aerofoil, a platform, a shank and a root. The rotor comprises a plurality of circumferentially spaced axially extending slots. The root of each rotor blade is arranged to locate in a respective one of the axially extending slots in the periphery of the rotor. The roots of the rotor blades are generally fir tree shaped or dovetail shaped and the axially extending slots are correspondingly shaped to receive the roots of the rotor blades.

One bladed rotor arrangement also comprises a plurality of lock plates arranged at a first axial end of the rotor and a plurality of lock plates arranged at a second axial end of the rotor to prevent the rotor blades moving axially relative to the rotor. The lock plates also act as seals to prevent fluid flowing through the axially extending slots in the rotor and axially between the shanks of the rotor blades and radially between the platforms of the rotor blades and the periphery of the rotor. The radially outer ends of lock plates at the first axial end of the rotor engage grooves defined by radially inwardly extending flanges on the platforms of the rotor blades and the radially outer ends of the lock plates at the second axial end of the rotor engage grooves defined by radially inwardly extending flanges on the platforms of the rotor blades. The radially inner ends of the lock plates at the first axial end of the rotor engage a circumferentially extending groove defined by the rotor and a seal plate arranged at the first axial end of the rotor and the radially inner ends of the lock plates at the second axial end of the rotor engage a circumferentially extending groove defined by the rotor and a seal plate arranged at the second axial end of the rotor. The seal plates are designed to remain rotationally stationary relative to the bladed rotor.

Another bladed rotor arrangement also comprises a plurality of lock plates arranged at a first axial end of the rotor to prevent the rotor blades moving axially relative to the rotor. The lock plates also act as seals to prevent fluid flowing through the axially extending slots in the rotor and axially between the shanks of the rotor blades and radially between the platforms of the rotor blades and the periphery of the rotor. The radially outer ends of lock plates at the first axial end of the rotor engage grooves defined by radially inwardly extending flanges on the platforms of the rotor blades. The radially inner ends of the lock plates at the first axial end of the rotor engage a circumferentially extending groove defined by the rotor and a seal plate arranged at the first axial end of the rotor. The seal plates are designed to remain rotationally stationary relative to the bladed rotor.

A further bladed rotor arrangement also comprises a plurality of lock plates arranged at a first axial end of the rotor and a plurality of lock plates arranged at a second axial end of the rotor to prevent the rotor blades moving axially relative to the rotor. The lock plates also act as seals to prevent fluid flowing through the axially extending slots in the rotor and axially between the shanks of the rotor blades and radially between the platforms of the rotor blades and the periphery of the rotor. The radially outer ends of lock plates at the first axial end of the rotor engage grooves defined by radially inwardly extending flanges on the platforms of the rotor blades and the radially outer ends of the lock plates at the second axial end of the rotor engage grooves defined by radially inwardly extending flanges on the platforms of the rotor blades. The radially inner ends of the lock plates at the first axial end of the rotor engage a circumferentially extending groove defined by the rotor and the radially inner ends of the lock plates at the second axial end of the rotor engage a circumferentially extending groove defined by the rotor. The seal plates are designed to remain rotationally stationary relative to the bladed rotor.

Another bladed rotor arrangement also comprises a plurality of lock plates arranged at a first axial end of the rotor to prevent the rotor blades moving axially relative to the rotor. The lock plates also act as seals to prevent fluid flowing through the axially extending slots in the rotor and axially between the shanks of the rotor blades and radially between the platforms of the rotor blades and the periphery of the rotor. The radially outer ends of lock plates at the first axial end of the rotor engage grooves defined by radially inwardly extending flanges on the platforms of the rotor blades. The radially inner ends of the lock plates at the first axial end of the rotor engage a circumferentially extending groove defined by the rotor. The seal plates are designed to remain rotationally stationary relative to the bladed rotor.

The lock plates are arranged to have sufficient stiffness in the radial direction to resist crushing and/or buckling due to their own weight at all engine rotational speeds. The lock plates must have as small a weight as possible to reduce parasitic centrifugal loading on the roots of the rotor blades and the slots of the rotor.

Currently the lock plates have a combined weight equivalent to about 15% of the weight of the rotor blades and thus the lock plates provide a significant contribution to the centrifugal load on the rim of the rotor. The load on the rim of the rotor is a life limiting factor of the rotor.

According to a first aspect of the disclosure there is provided a bladed rotor arrangement comprising a rotor, a plurality of rotor blades and a plurality of lock plates, the rotor blades being mounted on the periphery of the rotor, each rotor blade comprising an aerofoil, a platform, a shank and a root, the rotor comprising a plurality of circumferentially spaced axially extending slots, the root of each rotor blade locating in a respective one of the axially extending slots in the periphery of the rotor, a plurality of lock plates being arranged at a first axial end of the rotor, the radially outer ends of the lock plates at the first axial end of the rotor engaging grooves defined by radially inwardly extending flanges on the platforms of the rotor blades, the radially inner ends of the lock plates at the first axial end of the rotor engaging a circumferentially extending groove, wherein at least one of the lock plates being hollow.

Each lock plate may be hollow.

Each lock plate may comprise a first planar wall, a second planar wall spaced from the first planar wall and a peripheral wall extending around the periphery of the lock plate from the periphery of the first planar wall to the periphery of the second planar wall.

Each lock plate may comprise a plurality of walls arranged between and secured to the first planar wall and the second planar wall to stiffen the lock plate.

Each lock plate may comprise a cellular wall structure arranged between and secured to the first planar wall and the second planar wall to stiffen the lock plate.

The cellular wall structure may be a honeycomb wall structure.

Each lock plate may comprise a plurality of radially extending walls to stiffen the lock plate.

Each lock plate may have a plurality of inlet openings in the second planar wall interconnecting with radially extending passages defined between the radially extending walls and the lock plate having a plurality of outlet openings in the second planar wall interconnecting with the radially extending passages defined between the radially extending walls and the outlet openings in the second planar wall being spaced radially from the inlet openings.

Each lock plate may have a projection extending away from the second planar wall and the outlet openings extending through the projection.

The bladed rotor arrangement may comprise at least one seal plate arranged at the first axial end of the rotor, the radially inner ends of the lock plates at the first axial end of the rotor engaging a circumferentially extending groove at least partially defined by the at least one seal plate at the first axial end of the rotor.

The radially inner ends of the lock plates at the first axial end of the rotor may engage a circumferentially extending groove defined by the first axial end of the rotor.

A plurality of lock plates may be arranged at a second axial end of the rotor, the radially outer ends of the lock plates at the second axial end of the rotor engaging grooves defined by radially inwardly extending flanges on the platforms of the rotor blades, the radially inner ends of the lock plates at the second axial end of the rotor engaging a circumferentially extending groove, wherein at least one of the lock plates being hollow.

The bladed rotor arrangement may comprise at least one seal plate arranged at the second axial end of the rotor, the radially inner ends of the lock plates at the second axial end of the rotor engaging a circumferentially extending groove at least partially defined by the at least one seal plate at the second axial end of the rotor.

The radially inner ends of the lock plates at the second axial end of the rotor may engage a circumferentially extending groove defined by the second axial end of the rotor.

According to a second aspect of the disclosure there is provided a lock plate for a bladed rotor arrangement, wherein the lock plate is hollow.

The lock plate may comprise a first planar wall, a second planar wall spaced from the first planar wall and a peripheral wall extending around the periphery of the lock plate from the periphery of the first planar wall to the periphery of the second planar wall.

The lock plate may comprise a plurality of walls arranged between and secured to the first planar wall and the second planar wall to stiffen the lock plate.

The lock plate may comprise a cellular wall structure arranged between and secured to the first planar wall and the second planar wall to stiffen the lock plate. The cellular wall structure may be a honeycomb wall structure.

The lock plate may comprise a plurality of radially extending walls to stiffen the lock plate.

The lock plate may have a plurality of inlet openings in the second planar wall interconnecting with radially extending passages defined between the radially extending walls and the lock plate having a plurality of outlet openings in the second planar wall interconnecting with the radially extending passages defined between the radially extending walls and the outlet openings in the second planar wall being spaced radially from the inlet openings.

The lock plate may have a projection extending away from the first planar wall and the outlet openings extending through the projection.

The lock plate may be manufactured by metal injection moulding (MIM).

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which.

Figure 1:
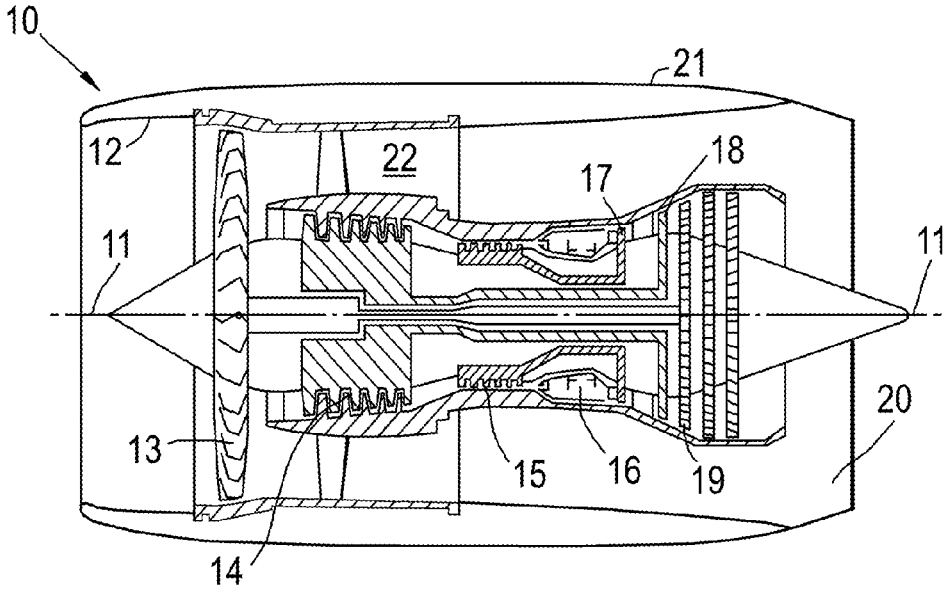
FIG. 1 is a sectional side view of a gas turbine engine.
Figure 2:
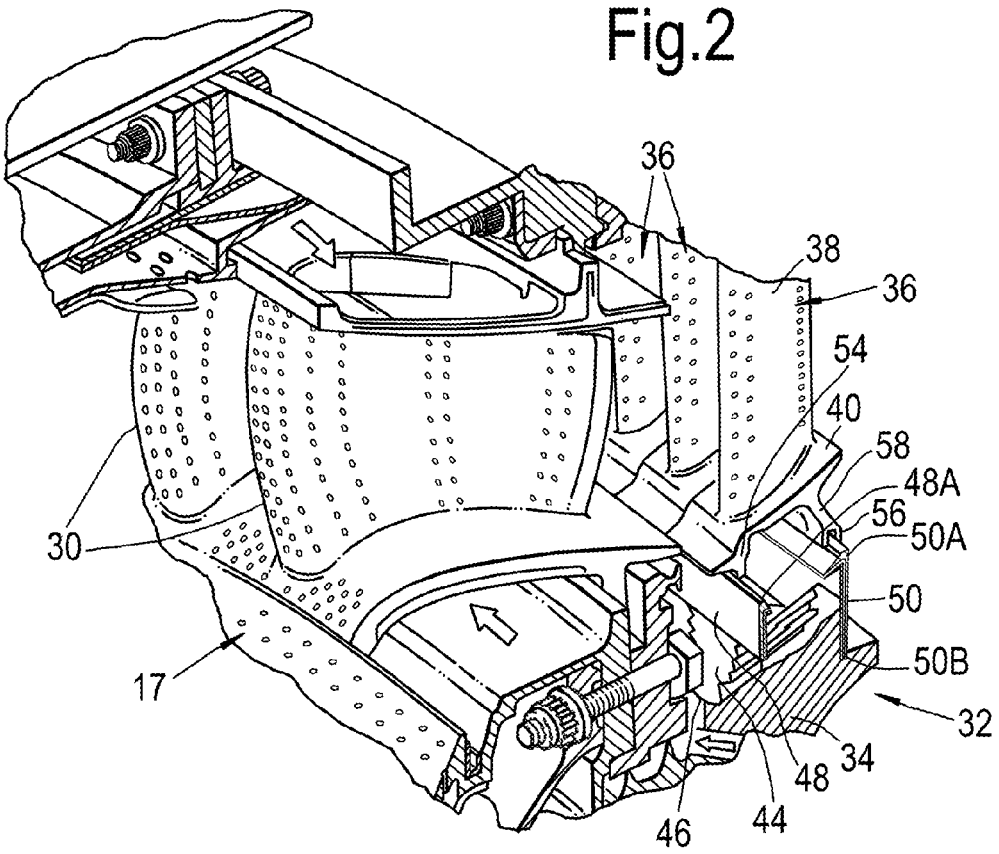
FIG. 2 is a perspective view of part of a turbine of the turbofan gas turbine engine showing the bladed rotor arrangement according to the present disclosure.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, and intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18 and 19 respectively before being exhausted through the nozzle 20 to provide additional propulsive thrust. The high pressure turbine 17, the intermediate pressure turbine 18 and the low pressure turbine 19 drive respectively the high pressure compressor 15, the intermediate pressure compressor 14 and the fan 13, each by suitable interconnecting shaft.

A part of the high pressure turbine 17 of the turbofan gas turbine engine 10 is shown more clearly in FIGS. 2 to 7. The high pressure turbine 17 comprises a plurality of nozzle guide vanes 30 which guide hot gases from the combustion chamber 16 onto the turbine rotor blades 36 of a bladed turbine rotor arrangement 32. The bladed turbine rotor arrangement 32 comprises a turbine rotor 34, a plurality of turbine rotor blades 36 and a plurality of lock plates 48 and 50. The turbine rotor blades 36 are mounted on the periphery of the turbine rotor 34 and each turbine rotor blade 36 comprises an aerofoil 38, a platform 40, a shank 42 and a root 44. The turbine rotor 34 comprises a plurality of circumferentially spaced axially extending slots 46 and the root 44 of each turbine rotor blade 36 locates in a respective one of the axially extending slots 46 in the periphery of the turbine rotor 34. The turbine rotor 34 in this example comprises a turbine disc. The roots 44 of the turbine rotor blades 36 are generally fir tree shaped and the axially extending slots 46 are correspondingly shaped to receive the roots 44 of the turbine rotor blades 36. However, the roots 44 of the turbine rotor blades 36 may be dovetail shaped and the axially extending slots 46 are correspondingly shaped to receive the roots 44 of the turbine rotor blades 36.

A plurality of lock plates 48 are arranged at a first axial end, the upstream end, of the turbine rotor 34 and a plurality of lock plates 50 are arranged at a second axial end, the downstream end, of the turbine rotor 34. The lock plates 48 and 50 prevent the turbine rotor blades 36 moving axially upstream and downstream respectively relative to the turbine rotor 34. The lock plates 48 and 50 also acts as seals to prevent fluid flowing through the axially extending slots 46 in the turbine rotor 34 and axially between the shanks 42 of the turbine rotor blades 36 and radially between the platforms 40 of the turbine rotor blades 36 and the periphery of the turbine rotor 34. The radially outer ends 48A of the lock plates 48 at the first axial end of the turbine rotor 34 engage grooves 52 defined by radially inwardly extending flanges 54 on the first axial ends, upstream ends, of the platforms 40 of the turbine rotor blades 36 and the radially outer ends 50A of the lock plates 50 at the second axial end of the turbine rotor 34 engage grooves 56 defined by radially inwardly extending flanges 58 on the second axial ends, downstream ends, of the platforms 40 of the turbine rotor blades 36. The radially inner ends 48B and 50B of the lock plates 48 and 50 engage circumferentially extending grooves 60 and 62 respectively.

Figure 3:
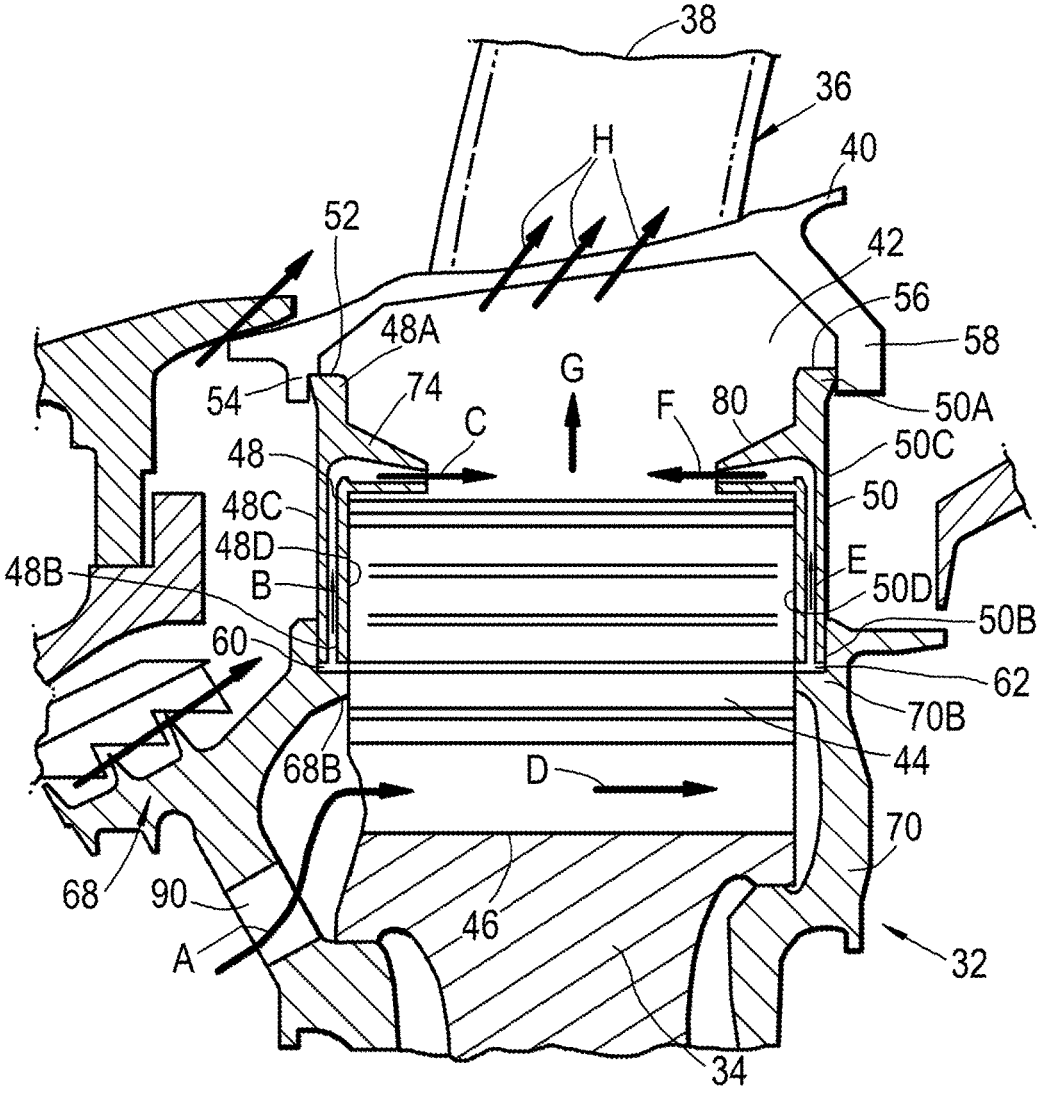
FIG. 3 is an enlarged cross-sectional view of the bladed rotor arrangement according to the present disclosure.
Figure 4:
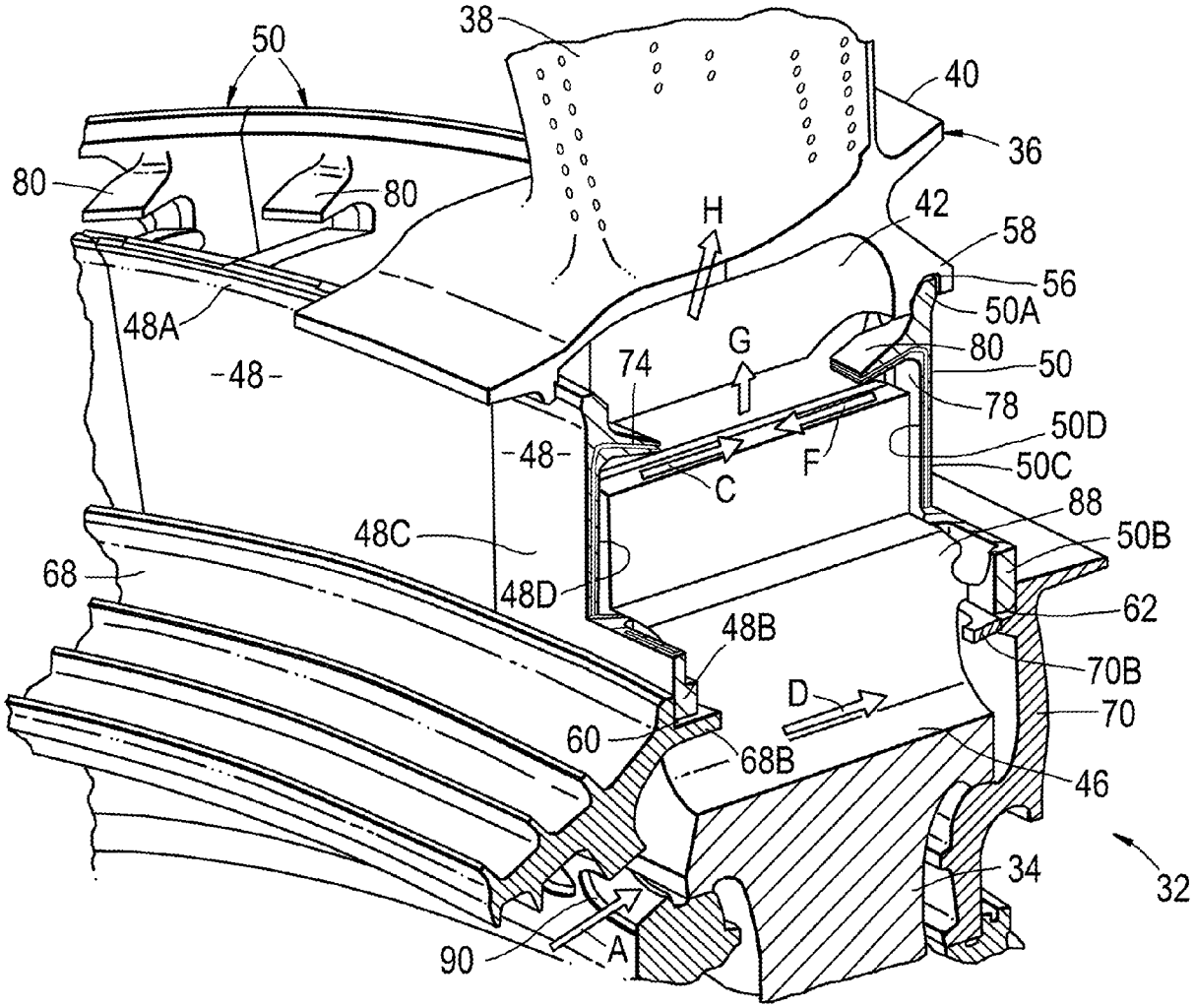
FIG. 4 is a perspective sectional side view of the bladed rotor arrangement according to the present disclosure.

The bladed turbine rotor arrangement 32 also comprises a plurality of seal plates, as seen in FIGS. 3 and 4. A single seal plate 68 or a plurality of seal plates 68 are arranged at the first axial end of the turbine rotor 34 and a single seal plate 70 or a plurality of seal plates 70 are arranged at the second axial end of the turbine rotor 34. If a single seal plate 68 is used then this is a ring and if a single seal plate 70 is used then this is a ring. The radially inner ends 48B of the lock plates 48 at the first axial end of the turbine rotor 34 engage, locate in, the circumferentially extending groove 60 at least partially defined by the seal plate, or seal plates, 68 at the first axial end of the turbine rotor 34 and the first axial end of the turbine rotor 34. The radially inner ends 50B of the lock plates 50 at the second axial end of the turbine rotor 34 engage, locate in, the circumferentially extending groove 62 at least partially defined by the seal plate, or seal plates, 70 at the second axial end of the turbine rotor 34 and the second axial end of the turbine rotor 34. The seal plate 68 is arranged to press the lock plates 48 towards the first axial end of the turbine rotor 34 and similarly the seal plate 70 is arranged to press the lock plates 50 towards the second axial end of the turbine rotor 34.

The seal plate, or seal plates, 68 have an outer radius which is less than the outer radius of the periphery of the turbine rotor 34, the seal plate, or seal plates, 68 have an outer radius which is greater than the radius of the radially inner ends of the slots 46 in the periphery of the turbine rotor 34 and the seal plate, or seal plates, 68 have an outer radius which is greater than the radius of the radially inner ends of the roots 44 of the turbine rotor blades 36. Similarly the seal plate, or seal plates, 70 have an outer radius which is less than the outer radius of the periphery of the turbine rotor 34, the seal plate, or seal plates, 70 have an outer radius which is greater than the radius of the radially inner ends of the slots 46 in the periphery of the turbine rotor 34 and the seal plate, or seal plates, 70 have an outer radius which is greater than the radius of the radially inner ends of the roots 44 of the turbine rotor blades 36.

The seal plate 68 and the lock plates 48 are configured and dimensioned so that under adverse tolerances the inner radii of the lock plates 48 are always at a lower radius than the outer radius of the seal plate 68 and provide sufficient radial overlap. The seal plate 70 and the lock plates 50 are configured and dimensioned so that under adverse tolerances the inner radii of the lock plates 50 are always at a lower radius than the outer radius of the seal plate 70 and provide sufficient radial overlap.

Figure 5:
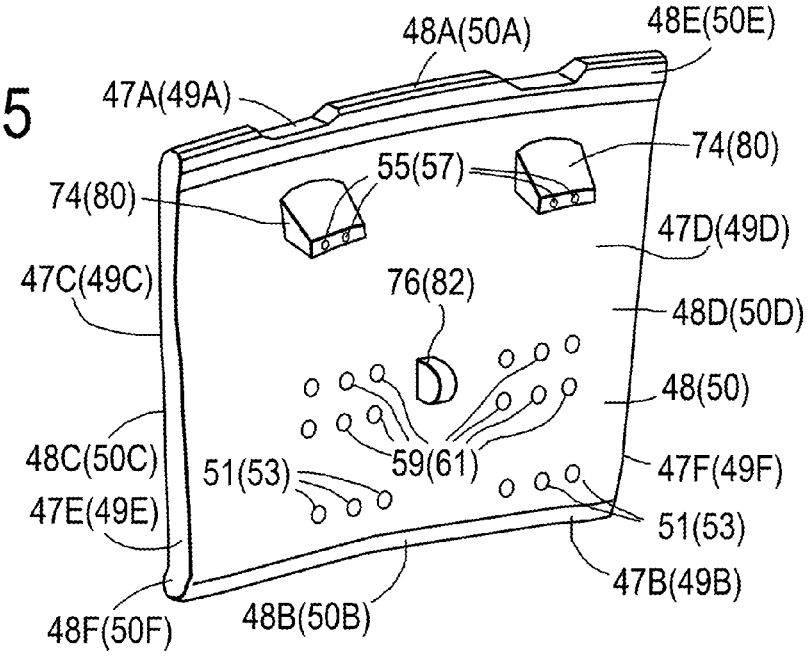
FIG. 5 is an enlarged perspective view of a lock plate of the bladed rotor arrangement according to the present disclosure.
Figure 6:
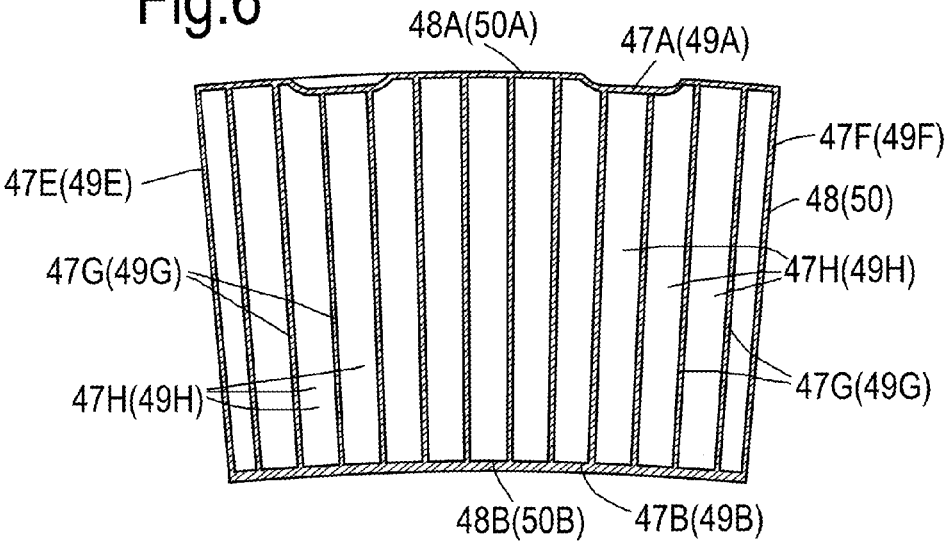
FIG. 6 is a radial cross-sectional view through the lock plate shown in FIG. 5.
Figure 7:
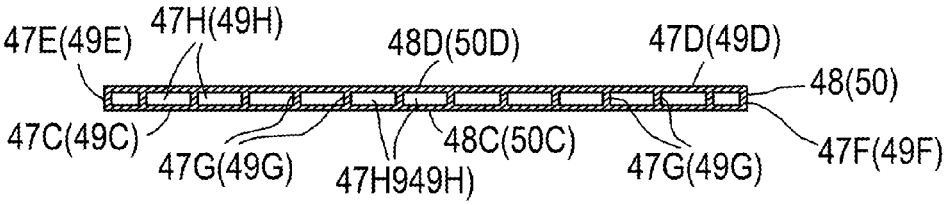
FIG. 7 is an axial cross-sectional view through the lock plate shown in FIG. 5.
Figure 8:
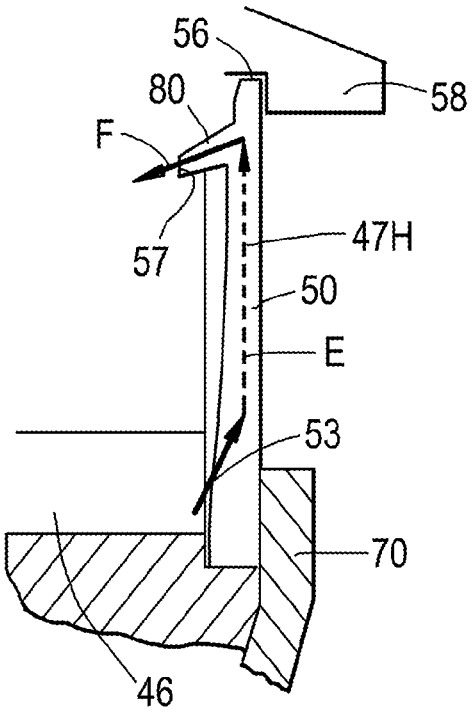
FIG. 8 is a schematic view of the lock plate and the bladed rotor arrangement shown in FIGS. 5 to 7.
Figure 9:
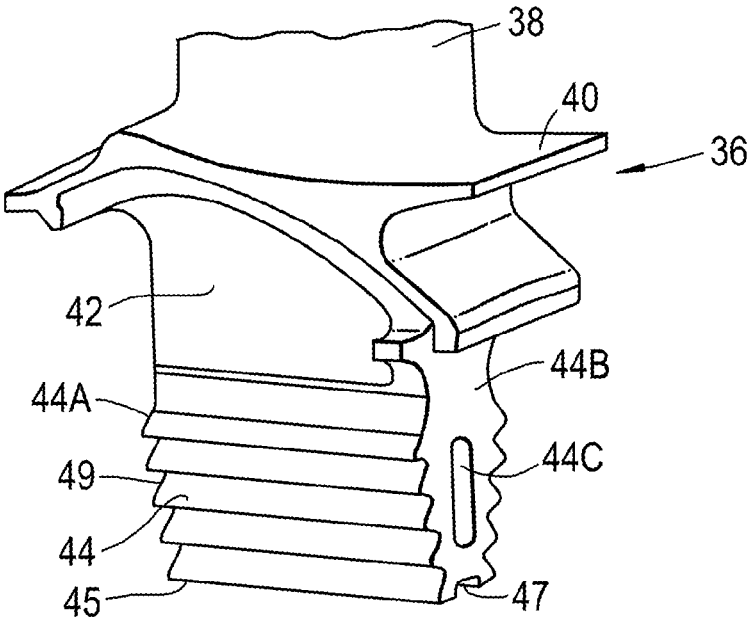
FIG. 9 is a perspective view of a turbine rotor blade of the bladed rotor arrangement shown in FIGS. 2 to 4.

The radially outer end 48A of each lock plate 48 has a lip 48E and the radially inner end 48B of each lock plate 48 has a lip 48F, as seen in FIG. 5. Each lock plate 48 has a first face 48C facing away from the turbine rotor 34 and a second face 48D facing the turbine rotor 34. The first face 48C of each lock plate 48 is generally flat between the lips at the radially inner and radially outer ends 48A and 48B of the lock plate 48. The lock plates 48 are hollow and each lock plate 48 comprises a radially outer wall 47A, a radially inner wall 47B, a first planar wall 47C, a second planar wall 47D, a first end wall 47E and a second end wall 47F. The second planar wall 47D is axially spaced from the first planar wall 47C and the radially outer wall 47A, the first end wall 47E, the radially inner wall 47B and the second end wall 47F are arranged around the periphery of the lock plate 48 and extend axially from the periphery of the first planar wall 47C to the periphery of the second planar wall 47D. The lock plate 48 also comprises a plurality of internal walls 47G arranged axially between and secured to the first planar wall 47C and the second planar wall 47D to stiffen the lock plate 48. The internal walls 47G extend radially from the radially outer wall 47A to the radially inner wall 47B and define a plurality of radially extending chambers 47H and the chambers 47H extend radially from the radially inner end 48B of the lock plate 48 towards the radially outer end 48A of the lock plate 48. The second face 48B of each lock plate 48 has at least one nozzle 74 and the at least one nozzle 74 is arranged at the radially outer end of the chambers 47H and the at least one nozzle 74 extends axially from the second face 48D of the lock plate 48. Preferably each lock plate 48 has a plurality of chambers 47H and a plurality of nozzles 74. Each chamber 47H extends radially from the radially inner end 48B of the lock plate 48 towards the radially outer end 48A of the lock plate 48 and each nozzle 74 has a plurality of openings 55 arranged at its axial end and each opening 55 is interconnected with a corresponding one of the chambers 47H in the lock plate 48. The lock plates 48 may also have additional openings 59 extending through the second planar wall 47D from the chambers 47H to the second faces 48D of the lock plates 48. The lock plates 48 also have inlet openings 51 extending through the second planar wall 47D from the chambers 47H to the second faces 48D of the lock plates 48.

Similarly, the radially outer end 50A of each lock plate 50 has a lip 50E and the radially inner end 50B of each lock plate 50 has a lip 50F, as seen in FIG. 5. Each lock plate 50 has a first face 50C facing away from the turbine rotor 34 and a second face 50D facing the turbine rotor 34. The first face 50C of each lock plate 50 is generally flat between the lips at the radially inner and radially outer ends 50A and 50B of the lock plate 50. The lock plates 50 are hollow and each lock plate 50 comprises a radially outer wall 49A, a radially inner wall 49B, a first planar wall 49C, a second planar wall 49D, a first end wall 49E and a second end wall 49F. The second planar wall 49D is axially spaced from the first planar wall 49C and the radially outer wall 49A, the first end wall 49E, the radially inner wall 49B and the second end wall 49F are arranged around the periphery of the lock plate 50 and extend axially from the periphery of the first planar wall 49C to the periphery of the second planar wall 49D. The lock plate 50 also comprises a plurality of internal walls 49G arranged axially between and secured to the first planar wall 49C and the second planar wall 49D to stiffen the lock plate 50. The internal walls 49G extend radially from the radially outer wall 49A to the radially inner wall 49B and define a plurality of radially extending chambers 49H and the chambers 49H extend radially from the radially inner end 50B of the lock plate 50 towards the radially outer end 50A of the lock plate 50. The second face 50B of each lock plate 50 has at least one nozzle 80 and the at least one nozzle 80 is arranged at the radially outer end of the chambers 49H and the at least one nozzle 80 extends axially from the second face 50D of the lock plate 50. Preferably each lock plate 50 has a plurality of chambers 49H and a plurality of nozzles 80. Each chamber 49H extends radially from the radially inner end 50B of the lock plate 50 towards the radially outer end 50A of the lock plate 50 and each nozzle 80 has a plurality of openings 57 arranged at its axial end and each opening 57 is interconnected with a corresponding one of the chambers 49G in the lock plate 50. The lock plates 50 may also have additional openings 61 extending through the second planar wall 49D from the chambers 49H to the second faces 50D of the lock plates 50. The lock plates 50 also have inlet openings 53 extending through the second planar wall 49D from the chambers 49H to the second faces 50D of the lock plates 50.

The second face 48D of each lock plate 48 has an anti-rotation feature 76. The anti-rotation feature 76 is a projection extending axially from the second face 48D of the lock plate 48 and is arranged to locate in a slot 49 at the first axial end, the upstream end, 44A of the root 44 of a turbine rotor blade 36. Alternatively, the anti-rotation feature may comprise a pair of circumferentially spaced projections extending axially from the second face of the lock plate, the projections being arranged to locate against the shanks of circumferentially spaced apart turbine rotor blades.

Similarly, the second face 50D of each lock plate 50 has an anti-rotation feature 82. The anti-rotation feature 82 is a projection extending axially from the second face 50D of the lock plate 50 and is arranged to locate in a slot 44C at the second axial end, the downstream end, 44B of the root 44 of a turbine rotor blade 36. Alternatively, the anti-rotation feature may comprise a pair of circumferentially spaced projections extending axially from the second face of the lock plate, the projections being arranged to locate against the shanks of circumferentially spaced apart turbine rotor blades.

In operation coolant, air, A is supplied through apertures 90 in the seal plate, or seal plates, 68 and the coolant flows radially outwardly over the upstream surface of the turbine rotor 34. The chambers 47H and 49H within the lock plates 48 and 50 respectively define passages to enable flows of coolant, air, B and E respectively radially outwardly at the upstream and downstream ends of the turbine rotor 34 between the axially extending slots 46, e.g. over the surfaces of the turbine rotor posts 88. The coolant flow E initially flows D axially along the slots 46 and underneath the roots 44 of the turbine rotor blades 36. The coolant flows through the inlet openings 51 and 53 into the chambers 47H and 49H within the lock plates 48 and 50 respectively. The coolant then flows radially outwardly within the chambers 47H and 49H of the lock plates 48 and 50 respectively. The coolant, air, is then directed by the openings 55 and 57 within the nozzles 74 and 80 on the lock plates 48 and 50 respectively so that the coolant, air, flows C and F axially over the radially outer peripheral surface of the turbine rotor 34 axially between the axially extending slots 46. The portions of the turbine rotor 34 between the axially extending slots 46 are called turbine rotor posts 88. The coolant, air, then flows G into the spaces defined the between the platforms 40 and shanks 42 of adjacent turbine rotor blades 36, the turbine rotor posts 88 and the lock plates 48 and 50. The coolant, air, then flows H out of these spaces through apertures in the platforms 40 of the turbine rotor blades 36. Some of the coolant flow D through the slots 46 flows into the turbine rotor blades 36 to cool the rotor blades 36. The additional openings 59 and 61 in the lock plates 48 and 50 respectively may direct coolant, air, onto the upstream and downstream ends of the rotor posts 88. Thus, the seal plates 68 and 70 and the lock plates 48 and 50 control the coolant flow over the upstream and downstream surfaces of the turbine rotor 34, the surfaces of the turbine rotor posts 88 and the coolant flow into the turbine rotor blades 36.

Alternatively the lock plates 48 and 50 may not have the additional openings 59 and 61 and coolant may simply flow between the second faces 48D and 50D of the lock plates 48 and 50 and the surfaces at the upstream and downstream ends of the turbine rotor 34.

Figure 10:
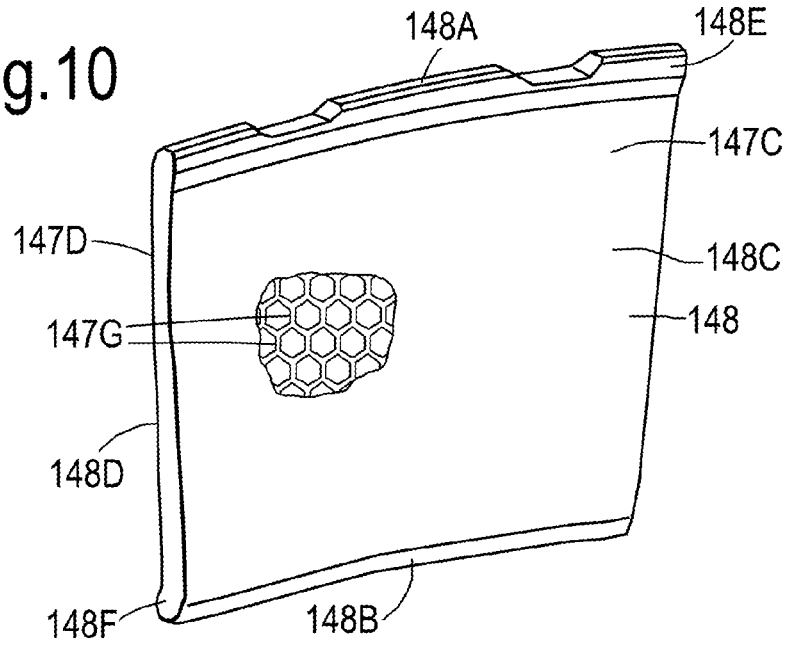
FIG. 10 is an enlarged perspective view of a further lock plate of the bladed rotor arrangement according to the present disclosure.

An alternative, simpler, lock plate 148 is shown in FIG. 10 and the lock plate 148 comprises a radially outer end 148A, a radially inner end, a first surface 148C, a second surface 148D, a first lip 148E and a second lip 148F. The lock plate 148 is also hollow and comprises a plurality of walls 147G arranged between and secured to the first planar wall 147C and the second planar wall 147D to stiffen the lock plate 148. This lock plate 148 comprises a cellular wall structure arranged between and secured to the first planar wall 147C and the second planar wall 147D to stiffen the lock plate 148 and the cellular wall structure may be a honeycomb wall structure. The lock plate 148 does not have nozzles and chambers to provide a flow of coolant. The lock plate as shown does not have an anti-rotation feature, but it may be possible to provide an anti-rotation feature as described previously. Each of the lock plates is effectively a sealed unit.

Figure 11:
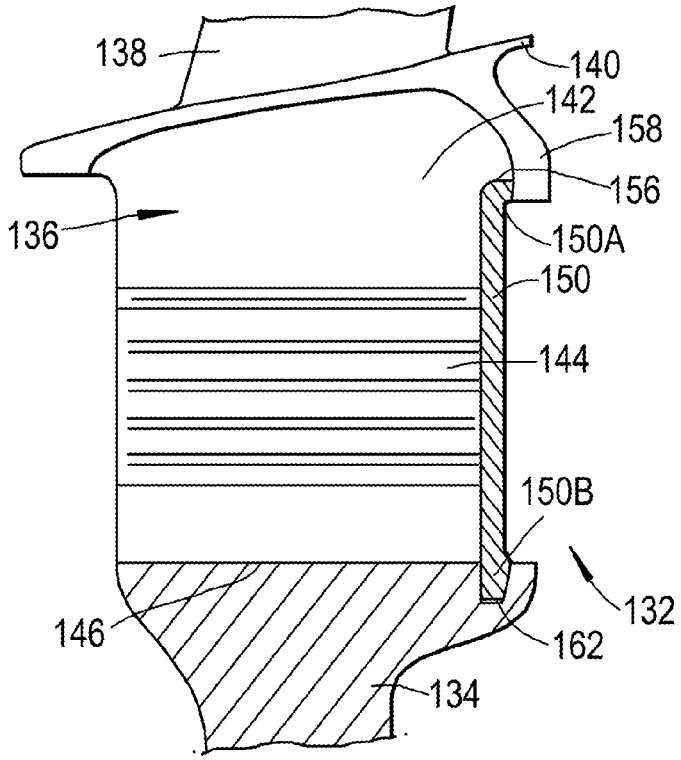
FIG. 11 is an enlarged cross-sectional view of another bladed rotor arrangement according to the present disclosure.

An alternative bladed turbine rotor arrangement 132, as shown in FIG. 11, comprises a turbine rotor 134, a plurality of turbine rotor blades 136 and a plurality of lock plates 150. The turbine rotor blades 136 are mounted on the periphery of the turbine rotor 134 and each turbine rotor blade 136 comprises an aerofoil 138, a platform 140, a shank 142 and a root 144. The turbine rotor 134 comprises a plurality of circumferentially spaced axially extending slots 146 and the root 144 of each turbine rotor blade 136 locates in a respective one of the axially extending slots 146 in the periphery of the turbine rotor 134. The turbine rotor 134 in this example comprises a turbine disc. The roots 144 of the turbine rotor blades 136 are generally fir tree shaped and the axially extending slots 146 are correspondingly shaped to receive the roots 144 of the turbine rotor blades 136. However, the roots 144 of the turbine rotor blades 136 may be dovetail shaped and the axially extending slots 146 are correspondingly shaped to receive the roots 144 of the turbine rotor blades 136.

A plurality of lock plates 150 are arranged at a first axial end, the downstream end, of the turbine rotor 134. The lock plates 150 prevent the turbine rotor blades 136 moving axially upstream and downstream respectively relative to the turbine rotor 134. The lock plates 150 also acts as seals to prevent fluid flowing through the axially extending slots 146 in the turbine rotor 134 and axially between the shanks 142 of the turbine rotor blades 136 and radially between the platforms 140 of the turbine rotor blades 136 and the periphery of the turbine rotor 134. The radially outer ends 150A of the lock plates 150 at the second axial end of the turbine rotor 134 engage grooves 156 defined by radially inwardly extending flanges 158 on the second axial ends, downstream ends, of the platforms 140 of the turbine rotor blades 136. The radially inner ends 150B of the lock plates 150 engage a circumferentially extending groove 162 at the second axial end, downstream end, of the turbine rotor 134. The lock plates 150 are hollow and may be as shown in FIGS. 5 to 8 or as shown in FIG. 10.

Another bladed rotor arrangement, similar to that shown in FIGS. 3 and 4, comprises a plurality of lock plates arranged at a first axial end of the rotor only to prevent the rotor blades moving axially relative to the rotor. The lock plates also act as seals to prevent fluid flowing through the axially extending slots in the rotor and axially between the shanks of the rotor blades and radially between the platforms of the rotor blades and the periphery of the rotor. The radially outer ends of lock plates at the first axial end of the rotor engage grooves defined by radially inwardly extending flanges on the platforms of the rotor blades. The radially inner ends of the lock plates at the first axial end of the rotor engage a circumferentially extending groove defined by the rotor and a seal plate arranged at the first axial end of the rotor. The first axial end of the rotor may be the upstream end or the downstream end of the rotor. The seal plates are designed to remain rotationally stationary relative to the bladed rotor. The lock plates are hollow and may be as shown in FIGS. 5 to 8 or as shown in FIG. 10.

A further bladed rotor arrangement, similar to that shown in FIG. 11, also comprises a plurality of lock plates arranged at a first axial end of the rotor and a plurality of lock plates arranged at a second axial end of the rotor to prevent the rotor blades moving axially relative to the rotor. The lock plates also act as seals to prevent fluid flowing through the axially extending slots in the rotor and axially between the shanks of the rotor blades and radially between the platforms of the rotor blades and the periphery of the rotor. The radially outer ends of lock plates at the first axial end of the rotor engage grooves defined by radially inwardly extending flanges on the platforms of the rotor blades and the radially outer ends of the lock plates at the second axial end of the rotor engage grooves defined by radially inwardly extending flanges on the platforms of the rotor blades. The radially inner ends of the lock plates at the first axial end of the rotor engage a circumferentially extending groove defined by the rotor and the radially inner ends of the lock plates at the second axial end of the rotor engage a circumferentially extending groove defined by the rotor. The seal plates are designed to remain rotationally stationary relative to the bladed rotor.

In other bladed rotor arrangement, similar to that shown in FIGS. 3 and 4 or FIG. 11, each one of the plurality of lock plates is similar to the lock plate shown in FIGS. 5 to 8 and comprises a plurality of internal walls arranged axially between and secured to the first planar wall and the second planar wall to stiffen the lock plate. But each of the lock plates does not have inlet openings in the second planar wall, does not have nozzles and openings in the nozzles and does not have additional openings in the second planar wall such that each of the lock plates is effectively a sealed unit.

According to the present disclosure the lock plate for a bladed rotor arrangement is hollow. The lock plate for a bladed rotor arrangement comprises a first planar wall, a second planar wall spaced from the first planar wall and a peripheral wall extending around the periphery of the lock plate from the periphery of the first planar wall to the periphery of the second planar wall. The peripheral wall comprises the radially outer wall, the first end wall, the radially inner wall and the second end wall.

The hollow lock plates may be manufactured by metal injection moulding (MIM). Metal injection moulding is a near net shape manufacturing process. The metal injection moulding process enables the hollow lock plates to be produced such that the lock plates have thin wall sections to create the hollow lock plates and the metal injection moulding process enables a plurality of walls to be arranged between and secured to the first planar wall and the second planar wall of each lock plate to stiffen the lock plate. Alternatively the hollow lock plates may be manufactured from a metal by additive layer manufacture (ALM). Additive layer manufacture is another near net shape manufacturing process or net shape manufacturing process. Examples of additive layer manufacture include selective laser sintering (SLS), selective laser melting (SLM), powder bed metallurgy using a laser or an electron beam, direct laser deposition (DLD) or direct metal lasers sintering (DMLS). Thus, the hollow lock plates manufactured by metal injection moulding or by additive layer manufacturing comprise a single, monolithic, piece.

The hollow lock plates may be manufactured in two parts and then the two parts are joined, or bonded, together especially to manufacture the hollow lock plate shown in FIG. 10.

The hollow lock plates have reduced weight compared to the solid lock plates and this reduces the centrifugal load on the rim of the rotor and reduces the stresses in the lock plate grooves on the rotor blades and hence increases the working life of the rotor and the working life of the rotor blades respectively. An additional benefit is that the reduced weight of the hollow lock plates reduces the stresses on the rotor blades. The lock plates are hollow and may be as shown in FIGS. 5 to 8 or as shown in FIG. 10.

Although the present disclosure has been described with reference to a bladed turbine rotor arrangement of a high pressure turbine it is equally applicable to a bladed turbine rotor arrangement of an intermediate pressure turbine or a low pressure turbine.

Although the present disclosure has been described with reference to a bladed turbine rotor arrangement it is equally applicable to a bladed compressor rotor arrangement, whether a high pressure compressor, an intermediate pressure compressor or a low pressure compressor or a fan. A bladed compressor rotor may comprise a compressor disc or a compressor drum. The bladed compressor rotor arrangement may comprise a compressor disc and a plurality of compressor rotor blades or a compressor drum and a plurality of compressor rotor blades.

The lock plates may comprise any suitable alloy, for example a nickel base alloy, a cobalt base alloy, an iron base alloy, a titanium base alloy, e.g. a nickel base superalloy, a cobalt base superalloy or an iron base superalloy for a bladed turbine rotor arrangement or may comprise steel or a titanium base alloy for a bladed compressor rotor arrangement.

Although the present disclosure has been described with reference to bladed rotor arrangement for a gas turbine engine, it is equally applicable to a bladed rotor arrangement for other types of turbomachine, e.g. a steam turbine etc.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A lock plate for a bladed rotor arrangement, wherein the lock plate is hollow, the lock plate comprises a first planar wall, a second planar wall spaced from the first planar wall and a peripheral wall extending around the periphery of the lock plate from the periphery of the first planar wall to the periphery of the second planar wall.

2. A lock plate as claimed in claim 1 wherein the lock plate comprises a plurality of walls arranged between and secured to the first planar wall and the second planar wall to stiffen the lock plate.

3. A lock plate as claimed in claim 2 wherein the lock plate comprises a cellular wall structure arranged between and secured to the first planar wall and the second planar wall to stiffen the lock plate.

4. A lock plate as claimed in claim 3 wherein the cellular wall structure is a honeycomb wall structure.

5. A lock plate as claimed in claim 2 wherein the lock plate comprises a plurality of radially extending walls to stiffen the lock plate.

6. A lock plate as claimed in claim 5 wherein the lock plate has a plurality of inlet openings in the second planar wall interconnecting with radially extending passages defined between the radially extending walls and the lock plate having a plurality of outlet openings in the second planar wall interconnecting with the radially extending passages defined between the radially extending walls and the outlet openings in the second planar wall being spaced radially from the inlet openings.

7. A lock plate as claimed in claim 6 wherein the lock plate has a projection extending away from the second planar wall and the outlet openings extending through the projection.

8. A bladed rotor arrangement comprising a rotor, a plurality of rotor blades and a plurality of lock plates, the rotor blades being mounted on the periphery of the rotor, each rotor blade comprising an aerofoil, a platform, a shank and a root, the rotor comprising a plurality of circumferentially spaced axially extending slots, the root of each rotor blade locating in a respective one of the axially extending slots in the periphery of the rotor, a plurality of lock plates being arranged at a first axial end of the rotor, the radially outer ends of the lock plates at the first axial end of the rotor engaging grooves defined by radially inwardly extending flanges on the platforms of the rotor blades, the radially inner ends of the lock plates at the first axial end of the rotor engaging a circumferentially extending groove, wherein at least one of the lock plates being hollow, the at least one plate comprises a first planar wall, a second planar wall spaced from the first planar wall and a peripheral wall extending around the periphery of the lock plate from the periphery of the first planar wall to the periphery of the second planar wall.

9. A bladed rotor arrangement as claimed in claim 8 wherein each lock plate being hollow.

10. A bladed rotor arrangement as claimed in claim 9 wherein each lock plate comprises a first planar wall, a second planar wall spaced from the first planar wall and a peripheral wall extending around the periphery of the lock plate from the periphery of the first planar wall to the periphery of the second planar wall.

11. A bladed rotor arrangement as claimed in claim 10 wherein each lock plate comprises a plurality of walls arranged between and secured to the first planar wall and the second planar wall to stiffen the lock plate.

12. A bladed rotor arrangement as claimed in claim 11 wherein each lock plate comprises a cellular wall structure arranged between and secured to the first planar wall and the second planar wall to stiffen the lock plate.

13. A bladed rotor arrangement as claimed in claim 12 wherein each cellular wall structure is a honeycomb wall structure.

14. A bladed rotor arrangement as claimed in claim 11 wherein each lock plate comprises a plurality of radially extending walls to stiffen the lock plate.

15. A bladed rotor arrangement as claimed in claim 14 wherein the lock plate has a plurality of inlet openings in the second planar wall interconnecting with radially extending passages defined between the radially extending walls and the lock plate having a plurality of outlet openings in the second planar wall interconnecting with the radially extending passages defined between the radially extending walls and the outlet openings in the second planar wall being spaced radially from the inlet openings.

16. A bladed rotor arrangement as claimed in claim 15 wherein the lock plate has a projection extending away from the second planar wall and the outlet openings extending through the projection.

17. A bladed rotor arrangement as claimed in claim 8 wherein at least one seal plate being arranged at the first axial end of the rotor, the radially inner ends of the lock plates at the first axial end of the rotor engaging a circumferentially extending groove at least partially defined by the at least one seal plate at the first axial end of the rotor.

18. A method of manufacturing a lock plate for a bladed rotor arrangement, wherein the lock plate is hollow, the lock plate comprises a first planar wall, a second planar wall spaced from the first planar wall and a peripheral wall extending around the periphery of the lock plate from the periphery of the first planar wall to the periphery of the second planar wall, the method comprising manufacturing the lock plate by a method selected from the group consisting of metal injection moulding and additive layer manufacturing.

* * * * *